US009103356B2

(12) United States Patent
Taguchi

(10) Patent No.: US 9,103,356 B2
(45) Date of Patent: Aug. 11, 2015

(54) OIL-PRESSURE APPARATUS

(75) Inventor: Yuichi Taguchi, Okayama (JP)

(73) Assignee: TAGUCHI INDUSTRIAL CO., LTD., Okayama (JP)

( * ) Notice: Subject to any disclaimer, the term of this patent is extended or adjusted under 35 U.S.C. 154(b) by 713 days.

(21) Appl. No.: 13/353,107

(22) Filed: Jan. 18, 2012

(65) Prior Publication Data

US 2013/0180395 A1 Jul. 18, 2013

(51) Int. Cl.

| | |
|---|---|
| ***F15B 13/06*** | (2006.01) |
| ***E02F 3/96*** | (2006.01) |
| ***E02F 9/22*** | (2006.01) |
| ***F15B 11/20*** | (2006.01) |

(52) U.S. Cl.

CPC ..... *F15B 13/06* (2013.01); *E02F 3/965* (2013.01); *E02F 9/2203* (2013.01); *F15B 11/20* (2013.01); *F15B 2211/3057* (2013.01); *F15B 2211/30505* (2013.01); *F15B 2211/329* (2013.01); *F15B 2211/7107* (2013.01); *F15B 2211/7121* (2013.01); *F15B 2211/783* (2013.01)

(58) Field of Classification Search

CPC ..... B30S 15/161; B66F 3/26; F15B 7/04; F15B 11/032; F15B 11/0325; F15B 15/22; F15B 15/221; F15B 2211/775; F15B 11/7121

USPC ..... 60/519, 564, 574, 591

See application file for complete search history.

(56) References Cited

U.S. PATENT DOCUMENTS

| | | | | |
|---|---|---|---|---|
| 4,455,921 | A * | 6/1984 | Griesbach | 91/191 |
| 6,742,334 | B2 * | 6/2004 | Fan | 60/479 |
| 6,973,780 | B2 * | 12/2005 | Hahn et al. | 60/413 |

FOREIGN PATENT DOCUMENTS

| | | |
|---|---|---|
| JP | H10-266587 A | 10/1998 |

* cited by examiner

*Primary Examiner* — Dwayne J White
*Assistant Examiner* — Matthew Wiblin
(74) *Attorney, Agent, or Firm* — DLA Piper LLP (US)

(57) ABSTRACT

An oil-pressure apparatus is provided with an actuating cylinder that works on the outside and an acceleration cylinder that does not work on the outside. When a rod of the actuating cylinder is extended with no load applied to the actuating cylinder, oil is supplied to the actuating cylinder through the acceleration cylinder so that extension of the rod is accelerated. When the rod of the actuating cylinder is extended with load applied to the actuating cylinder, oil is adjusted to the actuating cylinder without passing through the acceleration cylinder so that original thrust of the actuating cylinder is exerted.

1 Claim, 4 Drawing Sheets

OIL-PRESSURE APPARATUS

BACKGROUND OF THE INVENTION

1. Field of the Invention

The present invention relates to an oil-pressure apparatus for accelerating extension or retraction of a rod of an oil-pressure cylinder.

2. Description of the Related Art

An oil-pressure apparatus is used, for example, for a crusher attached to a boom of a power shovel. The crusher has a movable jaw and opens/closes the movable jaw in accordance with extension/retraction of the rod of the oil-pressure cylinder.

In this specification, the oil-pressure cylinder to actuate a working piece such as a movable jaw is referred to as the "actuating cylinder." The actuating cylinder contains a piston and a rod moving integrally with the piston in a tube. The inside of the tube is partitioned into a rod-side section on the rod side and a bottom-side section on the opposite side with the piston interposed therebetween.

Japanese Patent Application Publication No. 10-266587 (hereinafter referred to as JP 10-266587) discloses an oil-pressure apparatus which closes a movable jaw by extending an actuating cylinder. When the movable jaw is closed with no load applied on the movable jaw, a counter-balance valve 13 is in a closed state. When the piston of the actuating cylinder discharges oil from the rod-side section, the discharged oil is fed into the bottom-side section of the actuating cylinder through a bottom-side line. Also, Oil from a pipe connector B1 is supplied into the bottom-side section, thereby accelerating the extension of the rod. However, the use of this oil-pressure apparatus reduces thrust of the rod during acceleration (FIG. 1). When the movable jaw comes into contact with a target structure, the counter-balance valve 13 is opened to reset the thrust by oil to the original strength (FIG. 2).

The oil-pressure apparatus disclosed in JP 10-266587 accelerates the closing motion of the movable jaw but does not accelerate the opening motion. In order to readily understand the invention of JP 10-266587, it is assumed that the supply/discharge ratio of oil between the bottom-side section and the rod-side section of the actuating cylinder where the piston of the actuating cylinder is moved is 2:1, and oil is supplied at a flow rate of "1" from a pump through a rod-side line or the bottom-side line. When the movable jaw is closed, oil is discharged from the rod-side section. The discharged oil is returned to the bottom-side line and is added to the oil supplied from B1 to the bottom-side section (FIG. 1). Therefore, when the oil at a flow rate "1" is supplied from the pump through the bottom-side line to the bottom-side section, the oil at a flow rate "1" is returned from the rod-side section to the bottom-side line, so that oil at a flow rate "2" is supplied to the bottom-side section, thereby speeding up the closing motion of the movable jaw by two times as compared with the case where the discharged oil is not returned to the rod-side section. Substantially no pressure loss occurs since the oil discharged from the rod-side section is entirely returned to the bottom-side section.

By contrast, when the movable jaw is opened, the oil at a flow rate "1" is supplied from the pump to the rod-side section without any addition. Thus, the opening motion of the movable jaw is not speeded up. Rather, oil at a flow rate "2" is discharged from the bottom-side section to cause a pressure loss in the bottom-side line, which reduces the oil supplied from the rod-side line and thereby decelerates the movement of the piston. Speeding up the closing motion of the movable jaw may be thought to be enough for the crusher but will make no sense if the opening motion of the movable jaw becomes slower, in view of reduction of the crushing operation time on the whole.

An object of the present invention is to provide an oil-pressure apparatus for accelerating extension and retraction of a rod of an actuating cylinder.

SUMMARY OF THE INVENTION

The aforementioned problem is solved by an oil-pressure apparatus includes an actuating cylinder, an acceleration cylinder, and a bottom-side line which supplies oil. The actuating cylinder and the acceleration cylinder each include a piston and a rod moving integrally with the piston, and are each partitioned into a rod-side section on the rod side and a bottom-side section on the opposite side with the piston interposed therebetween. When the rod of the actuating cylinder is extended under no load, the bottom-side section of the acceleration cylinder is connected to the bottom-side section of the actuating cylinder, and the rod-side section of the acceleration cylinder is connected to the bottom-side line, whereby oil is supplied to the bottom-side section of the actuating cylinder through the acceleration cylinder. When the rod of the actuating cylinder is extended under load, the bottom-side section of the actuating cylinder is connected to the bottom-side line, whereby oil is supplied to the bottom-side section of the actuating cylinder without passing through the acceleration cylinder.

In the present invention, the supply/discharge ratio of oil between the bottom-side section and the rod-side section of the acceleration cylinder is preferably set equal to the supply/discharge ratio of oil between the bottom-side section and the rod-side section of the actuating cylinder. As long as the supply/discharge ratio of oil is equal between the acceleration cylinder and the actuating cylinder, the inner diameter of the tube and the movement range of the piston of the acceleration cylinder may be different from the inner diameter of the tube and the movement range of the piston of the actuating cylinder. However, it is preferable that the movement amounts of the pistons of the acceleration cylinder and the actuating cylinder should be equal in order to achieve the equal supply/discharge ratio of oil therebetween. Therefore, of the specifications of the acceleration cylinder and the actuating cylinder, at least the specifications concerning the inner diameter of the tube and the movement of the piston such as the movement range of the piston should be equal. It is more preferable that all the specifications of the acceleration cylinder and the actuating cylinder should be equal. The rod of the acceleration cylinder does not work on the outside and is always set in an unloaded state.

Preferably, selection between a path supplying oil to the actuating cylinder through the acceleration cylinder and a path supplying oil to the actuating cylinder without passing through the acceleration cylinder is carried out by a switch valve which opens/closes a valve depending on the oil pressure of a pilot line. More specifically, the oil-pressure apparatus further includes a first switch valve interposed between the acceleration cylinder and the bottom-side line. The first switch valve has an inlet, a first outlet, and a second outlet. The bottom-side section of the acceleration cylinder is connected to the bottom-side section of the actuating cylinder through a first bottom line. The first switch valve is connected with the bottom-side line through a first pilot line. The first switch valve connects the bottom-side line at the inlet, connects a first rod line connected to the rod-side section of the acceleration cylinder at the first outlet, and connects a first branch line in communication with the bottom-side section of the actuating cylinder at the second outlet.

The first switch valve switches between a path passing through the acceleration cylinder with priority given to the flow rate of oil and a path not passing through the acceleration cylinder with priority given to thrust. In the path passing through the acceleration cylinder, when the rod of the actuating cylinder is extended, the flow rate of oil fed into the bottom-side section is increased to accelerate the extension of the rod. In the path not passing through the acceleration cylinder, oil from the bottom-side line is directly fed into the bottom-side section of the actuating cylinder thereby achieving the original thrust of the actuating cylinder.

Preferably, when oil is supplied to the actuating cylinder without passing through the acceleration cylinder, the piston of the acceleration cylinder is moved along with the movement of the piston of the actuating cylinder. For this purpose, preferably, the oil-pressure circuit includes a second switch valve and a third switch valve. More specifically, the oil-pressure apparatus further includes a rod-side line to which oil from the actuating cylinder is discharged, a second switch valve interposed between the actuating cylinder and the first bottom line, and a third switch valve interposed between the actuating cylinder and the rod-side line. The second switch valve and the third switch valve each have an inlet, a first outlet, and a second outlet. The second switch valve is connected with the bottom-side line through a second pilot line. The third switch valve is connected with the bottom-side line through a third pilot line. The second switch valve connects the first bottom line connected to the bottom-side section of the acceleration cylinder at the inlet, connects a second bottom line connected to the bottom-side section of the actuating cylinder at the first outlet, and connects a second branch line in communication with the rod-side line at the second outlet. The third switch valve connects a second rod line connected to the rod-side section of the actuating cylinder at the inlet, connects the rod-side line at the first outlet, and connects a third branch line in communication with the rod-side section of the acceleration cylinder at the second outlet.

The second switch valve and the third switch valve bring the movements of the pistons of the actuating cylinder and the acceleration cylinder into synchronization. This prevents the piston of the acceleration cylinder from inhibiting the movement of the piston of the actuating cylinder, for example, from reaching the beginning end or the terminal end of the tube earlier.

The oil-pressure apparatus including the acceleration cylinder, the first switch valve, the second switch valve, and the third switch valve will now be described. In the description below, the oil-pressure apparatus of the present invention is used for a crusher attached to construction equipment, by way of example. It is assumed that the supply/discharge ratio of oil between the bottom-side section and the rod-side section of the actuating cylinder is 2:1. In other words, the area of the piston on the bottom side:the area of the piston on the rod side=2:1. The supply/discharge ratio of oil between the bottom-side section and the rod-side section of the acceleration cylinder is set to be equal to the supply/discharge ratio of the actuating cylinder (the area of the piston on the bottom side the area of the piston on the rod side=2:1). Then, it is assumed that oil at a flow rate "1" is supplied from the pump of the construction equipment through the rod-side line or the bottom-side line.

The extension of the rod of the actuating cylinder with no load applied thereto will now be described. First, oil at a flow rate "1" is fed into the rod-side section of the acceleration cylinder through the pump of the construction equipment, the bottom-side line, the first switch valve, and the first rod line to push the piston. Then, oil at a flow rate "2" is discharged from the bottom-side section of the acceleration cylinder. The oil at a flow rate "2" is fed into the bottom-side section of the actuating cylinder through the first bottom line, the second switch valve, and the second bottom line. As a result, the force pushing the piston of the actuating cylinder is reduced to half, while the moving speed of the piston doubles. Then, oil at a flow rate "1" is discharged from the rod-side section of the actuating cylinder. The discharged oil at a flow rate "1" is returned to the tank through the second rod line, the third switch valve, and the rod-side line. In this example, the flow rate of oil pushing the piston of the actuating cylinder can be made to "2" while the flow rate of oil supplied from the pump of the construction equipment and the flow rate of oil returned from the oil-pressure circuit to the tank of the construction equipment is "1". In the oil-pressure apparatus in the present invention, the flow rate of oil pushing the piston of the actuating cylinder can be increased, and the flow rate can be made equal between the oil supplied from the pump and the oil returned to the tank. This prevents a pressure loss thereby accelerating the extension of the rod of the actuating cylinder. Prevention of a pressure loss will be explained more concretely. In a case where the oil-pressure apparatus is used for a crusher attached to construction equipment, the crusher including the oil-pressure apparatus is attached to the main unit of the construction equipment. In this configuration, oil is supplied from the main unit to the oil-pressure apparatus and returned from the oil-pressure apparatus to the main unit. The larger the flow rate of the oil returned to the main unit becomes, the larger a pressure loss becomes. As mentioned above, the flow rate of the oil pushing the piston of the actuating cylinder is increased and larger than the flow rate of the oil supplied from the pump on the main unit side in the oil-pressure apparatus of the present invention. However, the increased flow rate is not kept until the oil is returned to the main unit, but the flow rate of the oil returned to the main unit is reduced to the flow rate of the oil supplied from the pump, thereby preventing the generation of a pressure loss.

The extension of the rod of the actuating cylinder with load applied on the rod of the actuating cylinder will now be described. For example, when the movable jaw of the crusher comes into contact with an object to impose load on the rod of the actuating cylinder, the oil pressure of the first pilot line, the second pilot line, and the third pilot line increases, so that the first switch valve, the second switch valve, and the third switch valve switch flow paths. Then, oil at a flow rate "1" supplied from the pump is directly fed into the bottom-side section of the actuating cylinder through the bottom-side line, the first switch valve, and the first branch line. The oil directly fed into the bottom-side section of the actuating cylinder exerts the original thrust to push the piston against the load. Oil at a flow rate "0.5" discharged from the rod-side section of the actuating cylinder is fed into the rod-side section of the acceleration cylinder through the second rod line, the third switch valve, the third branch line, and the first rod line. Oil at a flow rate "1" is returned from the bottom-side section of the acceleration cylinder to the tank through the first bottom line, the second switch valve, and the second branch line.

The retraction of the rod of the actuating cylinder will now be described. Oil at a flow rate "1" is fed from the pump into the rod-side section of the actuating cylinder through the rod-side line, the third switch valve, and the second rod line. Then, oil at a flow rate "2" is discharged from the bottom-side section of the actuating cylinder. The discharged oil is fed into the bottom-side section of the acceleration cylinder through the second bottom line, the second switch valve, and the first bottom line. Then, oil at a flow rate "1" is discharged from the rod-side section of the acceleration cylinder. The discharged oil is returned to the tank through the first rod line, the first switch valve, and the bottom-side line. In this manner, while the flow rate of oil pushing the piston of the acceleration cylinder is "2", the flow rate of oil supplied from the pump and the flow rate of oil returned to the tank are made equal at "1". This prevents a pressure loss also when the rod of the actuating cylinder is retracted. In other words, the movement of the piston of the actuating cylinder is prevented from deceleration and is accelerated as compared with the conventional technique.

According to the present invention, both extension and retraction of the rod of the actuating cylinder can be accelerated. In the present invention, the acceleration cylinder is interposed between the pump or tank and the actuating cylinder. Accordingly, the acceleration cylinder can increase oil fed into the actuating cylinder. Furthermore, the acceleration cylinder reduces oil returned from the actuating cylinder to the tank to equalize the amounts of oil fed from the pump and oil returned to the tank, thereby preventing a pressure loss. The oil-pressure apparatus of the present invention is also applicable to a double-jaw type crusher by applying the present invention to each of a pair of cylinders. A single-jaw type or double-jaw type crusher employing the present invention can shorten the time for crushing operations with faster opening and closing motions of the movable jaw.

DETAILED DESCRIPTION OF THE PREFERRED EMBODIMENTS

Figure 1:
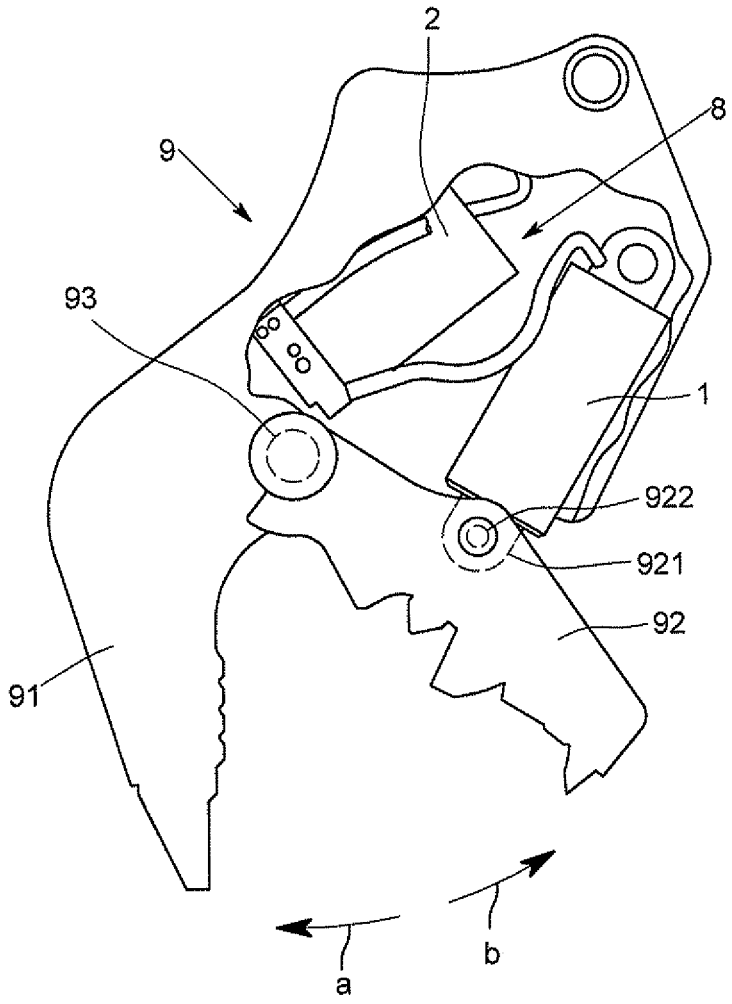
FIG. 1 is a schematic view of a crusher with an oil-pressure apparatus according to an embodiment of the present invention.

An embodiment of the present invention will be described with reference to the drawings. FIG. 1 is a schematic view of a crusher 9 with an oil-pressure apparatus 8 according to an embodiment of the present invention. For convenience of explanation, FIG. 1 shows the crusher 9 cut away to reveal an actuating cylinder 1 and an acceleration cylinder 2 which are arranged inside. The crusher 9 is an attachment attached to a main unit of construction equipment and others and actuated by the pressure of oil supplied from the main unit.

The crusher 9 includes an upper jaw 91 and a lower jaw 92. The lower jaw 92 is pivotably attached to the upper jaw 91 by means of a pivot shaft 93. The actuating cylinder 1 contains a rod. The extension/retraction of the rod moves a lower jaw support 921. The lower jaw 92 is attached to the lower jaw support 921 by means of a pivot shaft 922. The rod of the actuating cylinder 1 extends to cause the lower jaw support 921 to move integrally with the rod so as to push the lower jaw 92. The lower jaw 92 then pivots around the pivot shaft 93 to come closer to the upper jaw 91 (in the direction indicated by the arrow a). As a result, an object to be crushed between the upper jaw 91 and the lower jaw 92 is crushed. After the object is crushed, the rod of the actuating cylinder 1 is retracted to cause the lower jaw 92 to pivot in the opposite direction from when crushing (the direction indicated by the arrow b), thereby bringing back to the state in FIG. 1 in which the upper jaw 91 and the lower jaw 92 are completely opened.

Figure 2:
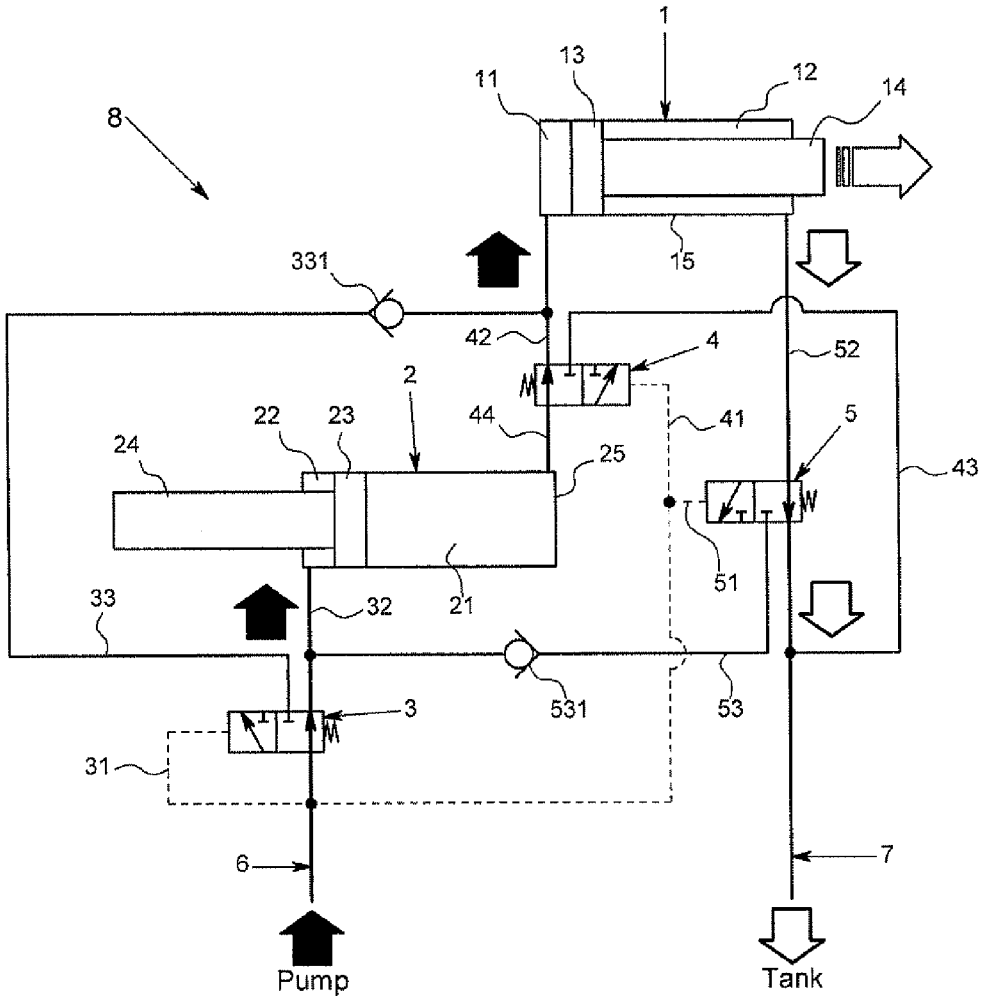
FIG. 2 is a block diagram showing an exemplary oil-pressure apparatus of the present invention to illustrate a flow of oil in a case where a rod of an actuating cylinder is extended under no load.

The structure of the oil-pressure apparatus 8 applied to the crusher will now be described with reference to FIG. 2. As shown in FIG. 2, the oil-pressure apparatus 8 in this example is configured to include a bottom-side line 6 extending from a pump or tank (neither shown), a rod-side line 7 extending from the pump or tank, the actuating cylinder 1 connected to the movable jaw of the crusher, an acceleration cylinder 2 interposed between the actuating cylinder 1 and the bottom-side line 6, a first switch valve 3 interposed between the acceleration cylinder 2 and the bottom-side line 6, a second switch valve 4 interposed between the actuating cylinder 1 and the acceleration cylinder 2, and a third switch valve 5 interposed between the actuating cylinder 1 and the rod-side line 7.

The acceleration cylinder 2 in this example and the actuating cylinder 1 are identical in specifications. Specifically, the supply/discharge ratio of oil between a bottom-side section 21 and a rod-side section 22 of the acceleration cylinder 2 is equal to the supply/discharge ratio of oil between a bottom-side section 11 and a rod-side section 12 of the actuating cylinder 1. Furthermore, the inner diameter of a tube 25 and the movement range of a piston 23 of the acceleration cylinder 2 are equal to the inner diameter of a tube 15 and the movement range of an actuating piston 13 of the actuating cylinder 1. The acceleration cylinder 2 differs from the actuating cylinder 1 in that it does not work on the outside and that no load is applied to a rod 24.

The first switch valve 3 has an inlet for connecting the bottom-side line 6, a first outlet for connecting a first rod line 32, and a second outlet connecting to a first branch line 33. The other end of the first rod line 32 connects to the rod-side section 22 of the acceleration cylinder 2. The other end of the first branch line 33 is in communication with the rod-side section 11 of the actuating cylinder 1. A first pilot line 31 has one end connected to the first switch valve 3 and has the other end connected to the bottom-side line 6. A bottom-side check valve 331 is arranged in the first branch line 33 to allow only the flow of oil directed to the bottom-side section 11 of the actuating cylinder 1. In the original state, the first switch valve 3 brings the bottom-side line 6 and the first rod line 32 in communication with each other. When the rod 14 of the actuating cylinder 1 is extended with no load applied thereto, oil is fed into the rod-side section 22 of the acceleration cylinder 2 through the bottom-side line 6 and the first rod line 32 (the thick black arrows in FIG. 2). When the rod 14 of the actuating cylinder 1 is retracted, oil is returned from the rod-side section 22 of the acceleration cylinder 2 to the tank through the first rod line 32 (the thick white arrows in FIG. 4). On the other hand, when the oil pressure of the bottom-side line 6 increases, the first switch valve 3 brings the bottom-side line 6 and the first branch line 33 into communication with each other. That is, when the rod 14 of the actuating cylinder 1 is extended under load, oil is fed into the bottom-side section 11 of the actuating cylinder 1 through the first branch line 33 (the thick black arrows in FIG. 3).

The second switch valve 4 has an inlet for connecting a first bottom line 44, a first outlet for connecting a second bottom line 42, and a second outlet for connecting a second branch line 43. The other end of the first bottom line 44 connects to the bottom-side section 21 of the acceleration cylinder 2. The other end of the second bottom line 42 connects to the bottom-side section 11 of the actuating cylinder 1. The other end of the second branch line 43 connects to the rod-side line 7. A second pilot line 41 has one end connected to the second switch valve 4 and has the other end in communication with the bottom-side line 6. In the original state, the second switch valve 4 brings the first bottom line 44 and the second bottom line 42 into communication with each other. When the rod 14 of the actuating cylinder 1 is extended with no load applied thereto, oil is fed from the bottom-side section 21 of the acceleration cylinder 2 into the bottom-side section 11 of the actuating cylinder 1 through the first bottom line 44 and the second bottom line 42 (the thick black arrow in FIG. 2). When the rod 14 of the actuating cylinder 1 is retracted, oil is fed from the bottom-side section 11 of the actuating cylinder 1 into the bottom-side section 21 of the acceleration cylinder 2 through the first bottom line 44 and the second bottom line 42 (the thick white arrow in FIG. 4). On the other hand, when the oil pressure of the bottom-side line 6 increases, the second switch valve 4 brings the first bottom line 44 and the second branch line 43 into communication with each other. Specifically, when the rod 14 of the actuating cylinder 1 is extended under load, oil is returned from the bottom-side section 21 of the acceleration cylinder 2 into the tank through the first bottom line 44 and the second branch line 43 (the thick white arrows in FIG. 3).

The third switch valve 5 has an inlet for connecting the second rod line 52, a first outlet for connecting the rod-side line 7, and a second outlet for connecting a third branch line 53. The other end of the second rod line 52 connects to the rod-side section 12 of the actuating cylinder 1. The other end of the third branch line 53 connects to the first rod line 32 connected to the bottom-side section 22 of the acceleration cylinder 2. A third pilot line 51 has one end connected to the third switch valve 5 and has the other end in communication with the bottom-side line 6. A rod-side check valve 531 is arranged in the third branch line 53 to allow only a flow of oil directed to the rod-side section 22 of the acceleration cylinder 2. In the original state, the third switch valve 5 brings the second rod line 52 and the rod-side line 7 into communication with each other. When the rod 14 of the actuating cylinder 1 is extended with no load applied thereto, oil returns to the tank through the second rod line 52 and the rod-side line 7 (the thick white arrows in FIG. 2). When the rod 14 of the actuating cylinder 1 is retracted, oil is fed into the rod-side section 12 through the rod-side line 7 and the second rod line 52 (the thick black arrows in FIG. 4). On the other hand, when the rod 14 of the actuating cylinder 1 is extended under load, the oil pressure of the bottom-side line 6 increases, so that the third switch valve 5 brings the second rod line 52 and the third branch line 53 into communication with each other. Oil is fed from the rod-side section 12 of the actuating cylinder 1 into the rod-side section 22 of the acceleration cylinder 2 through the third branch line 53 (the thick white arrows in FIG. 3).

The action of the oil-pressure apparatus in this example will be described, separately in the case of extension of the rod 14 of the actuating cylinder 1 under no load and under load and in the case of retraction. For the sake of simplicity, it is assumed that the supply/discharge ratio of oil between the bottom-side section 11 and the rod-side section 12 of the actuating cylinder 1 is 2:1. As the acceleration cylinder 2 and the actuating cylinder 1 are identical in specifications, the supply/discharge ratio of oil between the bottom-side section 21 and the rod-side section 22 of the acceleration cylinder 2 is also 2:1. The pump or tank is connected to the rod-side line 7 and the bottom-side line 6 (not shown). A switch valve (not shown) switches flow paths such that when one of the rod-side line 7 and the bottom-side line 6 is connected to the pump, the other is connected to the tank. It is assumed that the rod-side line 7 or the bottom-side line 6 connected to the pump supplies oil at a flow rate "1". In the figures, oil supplied toward the actuating cylinder 1 is represented by the thick black arrows, and oil discharged from the actuating cylinder 1 is represented by the thick white arrows.

The extension of the rod 14 of the actuating cylinder 1 with no load applied thereto will be described with reference to FIG. 2. The first switch valve 3 brings the bottom-side line 6 into communication with the first rod line 32. The second switch valve 4 brings the first bottom line 44 into communication with the second bottom line 42. The third switch valve 5 brings the second rod line 52 into communication with the rod-side line 7. Oil at a flow rate "1" supplied from the pump is fed into the rod-side section 22 of the acceleration cylinder 2 through the bottom-side line 6 and the first rod line 32 to push the piston 23, causing the rod 24 to retract. The movement of the piston 23 of the acceleration cylinder 2 causes oil at a flow rate "2" to be discharged from the bottom-side section 21. The discharged oil is fed into the bottom-side section 11 of the actuating cylinder 1 to push the piston 13, causing the rod 14 to extend. With no load applied to the rod 14 of the actuating cylinder 1, the pump only supplies oil at a flow rate "1". However, the oil fed into the bottom-side section 11 of the actuating cylinder 1 has a flow rate "2", which accelerates the movement of the piston 13 of the actuating cylinder 1. On the other hand, the piston 13 of the actuating cylinder 1 discharges oil at a flow rate "1" from the rod-side section 12 and returns the oil to the tank.

As the actuating cylinder 1 and the acceleration cylinder 2 in this example are identical in specifications, the piston 13 of the actuating cylinder 1 and the piston 23 of the acceleration cylinder 2 move by the same amount, and they move in synchronization with each other. This prevents the piston 23 of the acceleration cylinder 2 from reaching the beginning end or terminal end earlier than the piston 13 of the actuating cylinder 1, and thus from inhibiting the supply or exhaust of oil required to move the piston 13 of the actuating cylinder 1. As described later, with load applied to the rod 14 of the actuating cylinder 1, the oil discharged from the rod-side section 12 of the actuating cylinder 1 is returned to the rod-side section 22 of the acceleration cylinder 2, thereby achieving synchronization between the movements of the piston 13 of the actuating cylinder 1 and the piston 23 of the acceleration cylinder 2.

Figure 3:
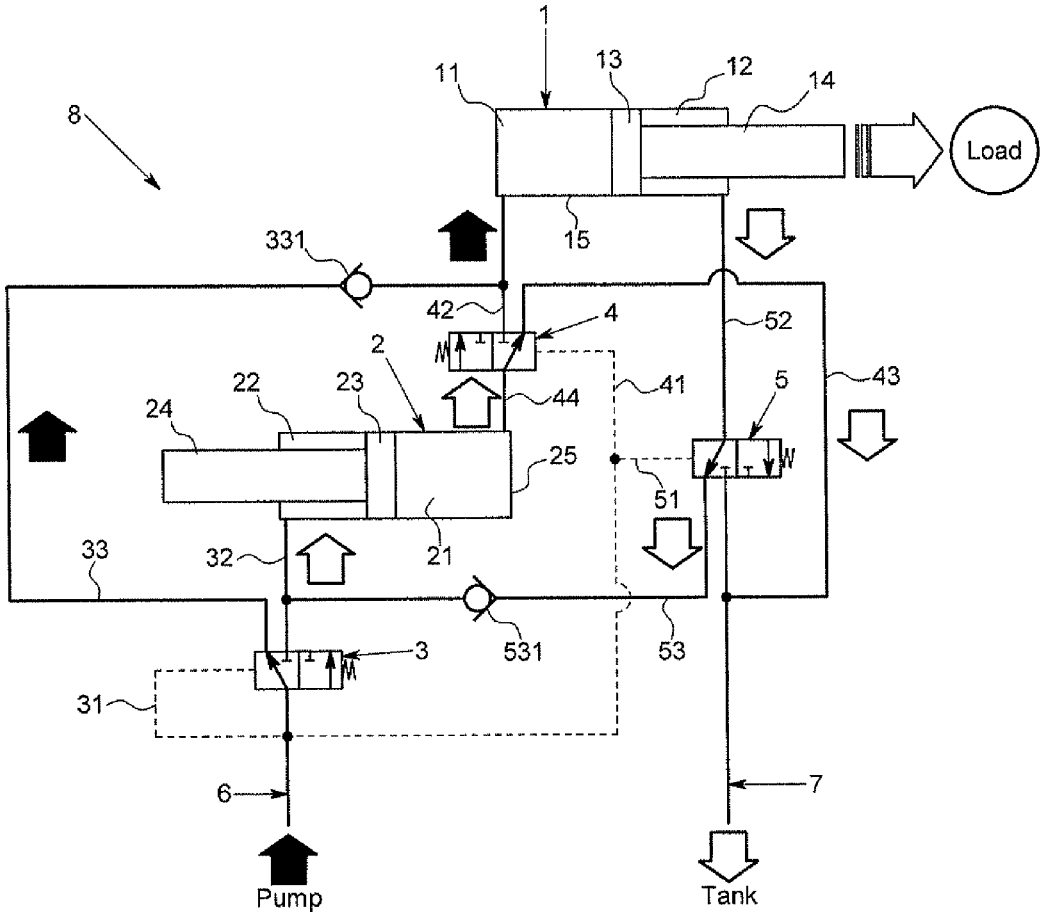
FIG. 3 is a block diagram showing the exemplary oil-pressure apparatus of the present invention to illustrate a flow of oil in a case where the rod of the actuating cylinder is extended under load.

The extension of the rod 14 of the actuating cylinder 1 with load applied thereto will be described with reference to FIG. 3. When the rod 14 of the actuating cylinder 1 is under load, the oil pressure of the bottom-side line 6 increases. Then, the first switch valve 3 brings the bottom-side line 6 into communication with the first branch line 33. The second switch valve 4 brings the first bottom line 44 into communication with the second branch line 43. The third switch valve 5 brings the second rod line 52 into communication with the third branch line 53. The oil at a flow rate "1" supplied from the pump is directly fed into the bottom-side section 11 of the actuating cylinder 1 through the first branch line 33 to push the piston 13 of the actuating cylinder 1, causing the operating rod 14 to extend. With no load applied to the rod 14 of the actuating cylinder 1, the thrust is reduced because oil at a flow rate "2" is fed into the bottom-side section 11 of the actuating cylinder 1 through the acceleration cylinder 2. When load is applied to the rod 14, oil at a flow rate "1" is fed into the bottom-side section 11 of the actuating cylinder 1 through the first branch line 33 as described above, thereby to achieve the original thrust. In other words, the first switch valve 3 forms a mechanism switching between a path with priority given to the flow rate of oil supplied through the bottom-side line 6 and a path with priority given to thrust.

The oil discharged from the rod-side section 12 by the movement of the piston 13 of the actuating cylinder 1 can be directly returned to the tank. However, in order to synchronize the movements of the piston 13 of the actuating cylinder 1 and the piston 23 of the acceleration cylinder 2 as described above, it is preferable that the oil discharged from the rod-side section 12 of the actuating cylinder 1 should be returned to the rod-side section 22 of the acceleration cylinder 2. Since oil at a flow rate "1" is supplied to the bottom-side section 11 of the actuating cylinder 1, oil at a flow rate "0.5" is discharged from the rod-side section 12. The oil discharged from the rod-side section 12 is fed into the rod-side section 22 of the acceleration cylinder 2 through the third branch line 53. The piston 23 of the acceleration cylinder 2, receiving the oil at a flow rate "0.5", moves by the same amount as the piston 13 of the actuating cylinder 1 to return oil at a flow rate "1" from the bottom-side section 21 to the tank. Since the piston 23 of the acceleration cylinder 2 moves by the same amount as the piston 13 of the actuating cylinder 1, the movements of the piston 14 of the actuating cylinder 1 and the piston 24 of the acceleration cylinder 2 can be synchronized with each other also when the rod 14 of the actuating cylinder 1 is extended under load. In other words, the second switch valve 4 and the third switch valve 5 form a mechanism for synchronizing the movements of the piston 14 of the actuating cylinder 1 and the piston 24 of the acceleration cylinder 2. The flow rate of oil returned to the tank through the acceleration cylinder 2 is "1" and the flow rate of oil supplied from the pump is also "1". A pressure loss can be prevented as described above since the amount of oil supplied to the oil-pressure circuit is equal to the amount of oil returned from the oil-pressure circuit to the tank.

Figure 4:
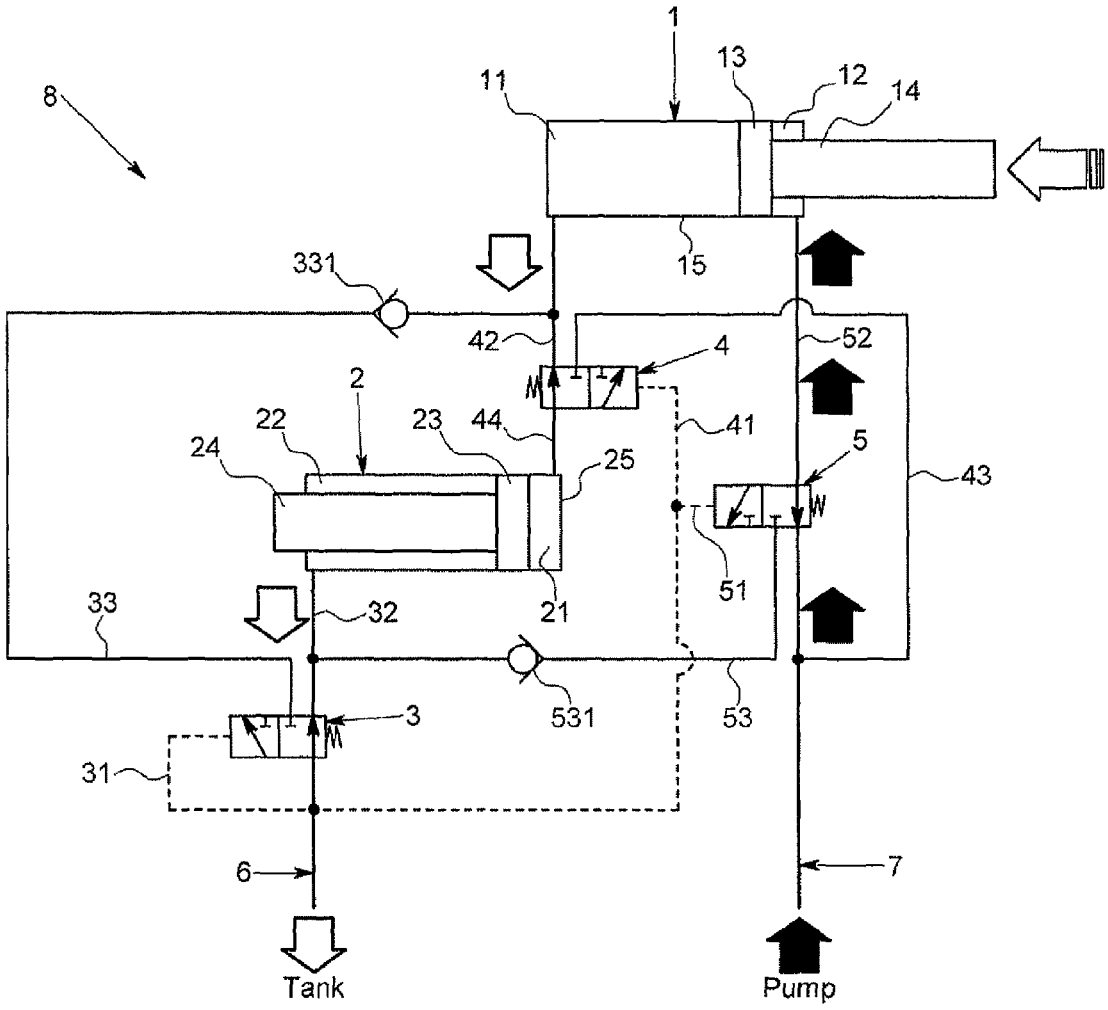
FIG. 4 is a block diagram showing the exemplary oil-pressure apparatus of the present invention to illustrate a flow of oil in a case where the rod of the actuating cylinder is retracted.

The retraction of the rod 14 of the actuating cylinder 1 will be described with reference to FIG. 4. The first switch valve 3 brings the bottom-side line 6 into communication with the first rod line 32. The second switch valve 4 brings the first bottom line 44 into communication with the second bottom line 42. The third switch valve 5 brings the second rod line 52 into communication with the rod-side line 7. Oil at a flow rate "1" supplied from the pump is fed into the rod-side section 12 of the actuating cylinder 1 through the rod-side line 7 and the second rod line 52 to push the piston 13 of the actuating cylinder 1, causing the rod 14 to retract. The movement of the piston 13 of the actuating cylinder 1 causes oil at a flow rate "2" to be discharged from the bottom-side section 11 of the actuating cylinder 1. The discharged oil at a flow rate "2" is fed into the bottom-side section 21 of the acceleration cylinder 2 through the second bottom line 42 and the first bottom line 44. The oil at a flow rate "2" received by the acceleration cylinder pushes the piston 23 of the acceleration cylinder 2 to cause the rod 24 to extend. The oil fed into the bottom-side section 21 of the acceleration cylinder 2 has the increased flow rate and thus accelerates the movement of the piston 23. However, the oil merely moves the piston 23 since the rod 24 of the acceleration cylinder 2 does not work on the outside.

When the piston 23 of the acceleration cylinder 2 moves, oil at a flow rate "1" is discharged from the rod-side section 22. The discharged oil is returned to the tank through the first rod line 32 and the bottom-side line 6. In this manner, the flow rate of oil returned to the tank through the acceleration cylinder 2 is "1" and the flow rate of oil supplied from the pump is also "1". A pressure loss can be prevented since the amount of oil supplied to the oil-pressure circuit is equal to the amount of oil returned from the oil-pressure circuit to the tank. The acceleration cylinder 2 in this example reduces the amount of oil discharged from the actuating cylinder 1 (in this example, by half) and returns the reduced oil to the tank. In summary, the present invention includes the acceleration cylinder 2 in the oil-pressure circuit to prevent a pressure loss. In the present invention, the retraction of the rod 14 of the actuating cylinder 1 is not absolutely accelerated because the amount of oil supplied to the rod-side section 12 of the actuating cylinder 1 is not increased during retraction. However, the movement of the piston 13 is not decelerated because of the prevention of a pressure loss, so that the retraction of the rod 14 can be accelerated as compared with the conventional oil-pressure apparatus.

Although the example that the supply/discharge ratio of both the actuating cylinder 1 and the acceleration cylinder 2 is same, i.e., the ratio is 2:1, is given in the aforementioned embodiment, the supply/discharge ratio of both cylinders 1, 2 may be different. For example, the supply/discharge ratio of the acceleration cylinder may be 1.9:1, and the supply/discharge ratio of the actuating cylinder may be 2:1. If the oil is supplied to the rod side section 22 of the acceleration cylinder 2 at the flow rate of "1", the oil at a flow rate "1.9" is supplied to the bottom side section 11 of the actuating cylinder 1, thereby accelerating a movement of the rod 14 of the actuating cylinder 1 in this example. On the other hand, the supply/discharge ratio of the actuating cylinder 1 is 2:1. Therefore, if the oil at flow rate "1.9" is supplied to the bottom side section 11 of the actuating cylinder 1, the flow rate of the oil discharged from the rod side section 12 of the actuating cylinder 1 is reduced by half, i.e, the flow rate "0.95". Therefore, the flow rate of the oil returned to the main unit of the construction equipment and others is suppressed, and a pressure loss is suppressed. Namely, even if the supply/discharge ratio of the actuating cylinder 1 and the acceleration cylinder 2 is different, an acceleration effect and a suppression effect for a pressure loss is also gained as in the case that a supply/discharge ratio is same.

When the rod 14 of the actuating cylinder 1 retracts, if the oil at flow rate "1" is supplied from the pump to the rod side section 12 of the actuating cylinder 1, the oil at flow rate "2" is discharged from the bottom side section 11 of the cylinder 1. This oil at flow the rate "2" is supplied to the bottom side section 21 of the acceleration cylinder 2, and the oil at the flow rate "2/1.9=1.05" is discharged from the rod side section 22. Although the flow rate is increased than the flow rate of the oil supplied from the pump, the flow rate "2" discharged from the bottom side section of the actuating cylinder 1 falls by approximately by half. Therefore, the flow rate of the oil returned to the main unit of the construction equipment and others is suppressed, and a pressure loss is suppressed.

In the foregoing embodiment, the oil-pressure apparatus of the present invention is used for a crusher, by way of example. However, the crusher is not limited to the structure shown in FIG. 1 as long as it is configured to be able to move at least one jaw to crush an object. The application of the oil-pressure apparatus of the present invention is not limited to a crusher. The present invention is able to accelerate the extension or retraction of the rod of an actuating cylinder and is thus usable as an oil-pressure apparatus for a variety of hydraulic equipment such as a press.

The invention claimed is:

1. An oil-pressure apparatus comprising:

an actuating cylinder;

an acceleration cylinder;

a bottom-side line which supplies oil, wherein the actuating cylinder and the acceleration cylinder each include a piston and a rod moving integrally with the piston and each is partitioned into a rod-side section on the rod side and a bottom-side section on the opposite side with the piston interposed therebetween, when the rod of the actuating cylinder is extended under no load, the bottom-side section of the acceleration cylinder is connected to the bottom-side section of the actuating cylinder, and the rod-side section of the acceleration cylinder is connected to the bottom-side line, whereby oil is supplied to the bottom-side section of the actuating cylinder through the acceleration cylinder, and when the rod of the actuating cylinder is extended under load, the bottom-side section of the actuating cylinder is connected to the bottom-side line, whereby oil is supplied to the bottom-side section of the actuating cylinder without passing through the acceleration cylinder;

a first switch valve interposed between the acceleration cylinder and the bottom-side line, wherein the first switch valve has an inlet, a first outlet, and a second outlet, the bottom-side section of the acceleration cylinder is connected to the bottom-side section of the actuating cylinder through a first bottom line, the first switch valve is connected with the bottom-side line through a first pilot line, and the first switch valve connects the bottom-side line at the inlet, connects a first rod line connected to the rod-side section of the acceleration cylinder at the first outlet, and connects a first branch line in communication with the bottom-side section of the actuating cylinder at the second outlet;

a rod-side line to which oil from the actuating cylinder is discharged;

a second switch valve interposed between the actuating cylinder and the first bottom line; and a third switch valve interposed between the actuating cylinder and the rod-side line, wherein the second switch valve and the third switch valve each have an inlet, a first outlet, and a second outlet, the second switch valve is connected with the bottom-side line through a second pilot line, the third switch valve is connected with the bottom-side line through a third pilot line, the second switch valve connects the first bottom line connected to the bottom-side section of the acceleration cylinder at the inlet, connects a second bottom line connected to the bottom-side section of the actuating cylinder at the first outlet, and connects a second branch line in communication with the rod-side line at the second outlet, and the third switch valve connects a second rod line connected to the rod-side section of the actuating cylinder at the inlet, connects the rod-side line at the first outlet, and connects a third branch line in communication with the rod-side section of the acceleration cylinder at the second outlet.

* * * * *